US007243737B2

(12) United States Patent
Michael

(10) Patent No.: US 7,243,737 B2
(45) Date of Patent: Jul. 17, 2007

(54) INTERCHANGEABLE REAMER

(75) Inventor: Tod J. Michael, Chariton, IA (US)

(73) Assignee: Vermeer Manufacturing Company, Pella, IA (US)

( * ) Notice: Subject to any disclaimer, the term of this patent is extended or adjusted under 35 U.S.C. 154(b) by 259 days.

(21) Appl. No.: 10/948,082

(22) Filed: Sep. 22, 2004

(65) Prior Publication Data

US 2006/0060384 A1 Mar. 23, 2006

(51) Int. Cl.
*E21B 10/26* (2006.01)

(52) U.S. Cl. ..... 175/53; 175/385

(58) Field of Classification Search ..... 175/53, 175/61, 62, 385

See application file for complete search history.

(56) References Cited

U.S. PATENT DOCUMENTS

| | | | | |
|---|---|---|---|---|
| 3,917,011 | A | 11/1975 | Hester | |
| 4,509,607 | A | 4/1985 | Saxman et al. | |
| 4,754,526 | A | 7/1988 | Tremoulet et al. | |
| 5,220,964 | A | 6/1993 | Deken et al. | |
| 5,390,750 | A | 2/1995 | Deken et al. | |
| 5,687,807 | A | 11/1997 | Woods et al. | |
| 5,921,331 | A | 7/1999 | Randall | |
| 5,979,573 | A | 11/1999 | Osadchuk | |
| 5,979,574 | A | 11/1999 | Osadchuk | |
| 6,250,403 | B1 | 6/2001 | Beckwith | |
| 6,386,298 | B1 | 5/2002 | Smith et al. | |
| 6,659,198 | B2 * | 12/2003 | Camp | 175/53 |
| 6,708,786 | B2 | 3/2004 | Cariveau et al. | |
| 6,729,418 | B2 | 5/2004 | Slaughter, Jr. et al. | |
| 2002/0088649 | A1 | 7/2002 | Morris et al. | |

FOREIGN PATENT DOCUMENTS

| | | |
|---|---|---|
| GB | 2349658 | * 11/2000 |

OTHER PUBLICATIONS

"Hard Rock Tool Specialists PALMIERI USA," *Palmieri*, 1 page (Date: publicly known prior to the filing date of the present application).

* cited by examiner

*Primary Examiner*—William Neuder
(74) *Attorney, Agent, or Firm*—Merchant & Gould P.C.

(57) ABSTRACT

The present disclosure relates to back reamers having bases including leading ends that can be connected to a drill string and trailing ends that can be connected to product desired to be pulled through a bore being backreamed. The back reamers also include reaming components that are detachably secured to the bases.

15 Claims, 14 Drawing Sheets

FIG. 2
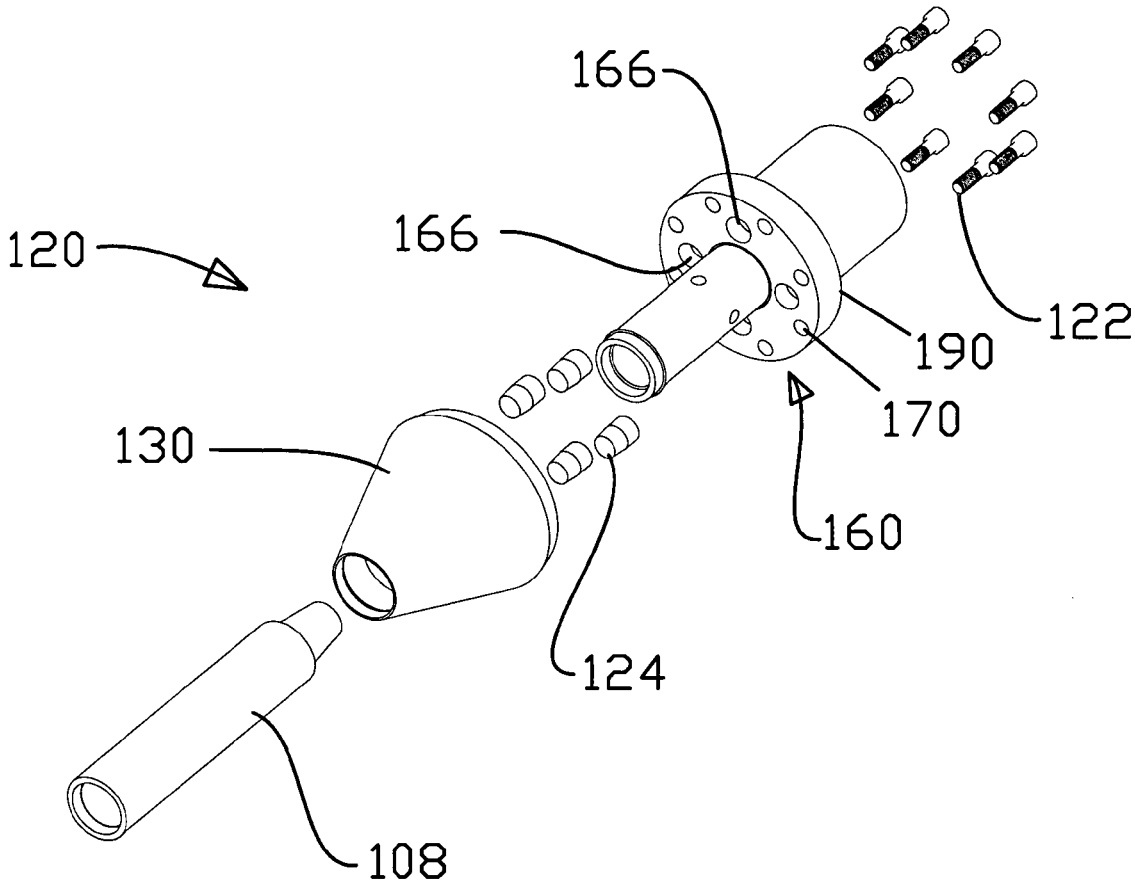
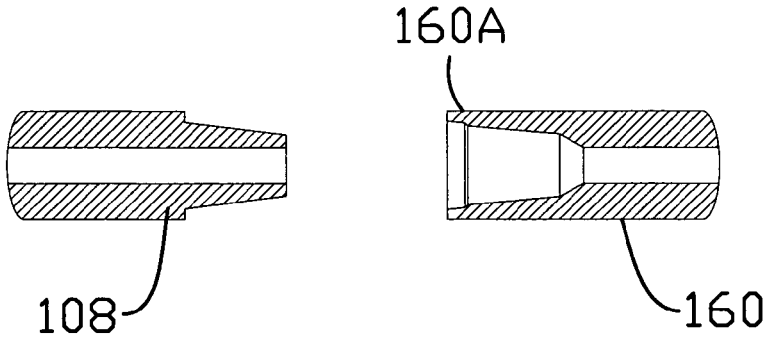
FIG. 5

INTERCHANGEABLE REAMER

TECHNICAL FIELD

The present disclosure relates generally to ground engaging tools. More specifically, the present disclosure relates to backreamers for use with drilling machines.

BACKGROUND

The process known as horizontal directional drilling is utilized to install a variety of underground utilities in a manner that does not disrupt the surface. In use, a drill machine is used drill a pilot bore that extends beneath the ground surface from an entry hole at the ground surface (i.e., a starting point) to an exit hole at the ground surface (i.e., an ending point). The pilot bore is drilled by rotating and pushing a ground engaging tool (e.g., a drill bit) that is attached to the end of a drill rod. The length of the pilot bore is extended by stringing multiple rods together to form a drill string. The direction of drilling can be controlled (i.e., the drill string can be "steered") by various techniques to control the depth of the pilot bore as well as the location of the exit hole. The location of the drill string, after the pilot bore is completed, represents the desired location of the utility to be installed.

After the pilot bore is drilled, the drill bit is typically removed and a second ground engaging tool installed onto the end of the drill string. This tool is typically known as a backreamer. Its function is to ream the drilled bore to a diameter sufficient to allow installation of the utility. To provide a reaming function, the backreamer is typically pulled back through the pilot bore by the drill string as the drill string is withdrawn from the pilot bore. Often times the utility being installed is attached with a swivel located at the end of the backreamer such that the utility is pulled into the reamed bore immediately behind the backreamer. In this way, the act of withdrawing the drill string will simultaneously result in the installation of the utility.

The type of utilities installed typically includes telecommunications, power, water, natural gas, liquid gas pipelines, potable water pipes and sewers. Due to this large variety of utilities, there is a large variety in the size requirements for the final reamed borehole, and thus a wide range of backreamer sizes is required.

Different styles of backreamers are typically used for different soil conditions. A backreamer, for instance, designed to operate effectively in a sandy soil, will not operate effectively in a heavy clay. Backreamers capable of boring through rock are significantly different than those used for either sandy soils or clay. In the situations where the borehole passes through rock, multiple passes of backreamers of sequentially larger diameter may be required to achieve the desired final borehole size. Examples of various backreamers can be found in; U.S. Pat. No. 6,250,403; U.S. Pat. No. 5,921,331; U.S. Pat. No. 5,687,807; U.S. Pat. No. 4,754,526; U.S. Pat. No. 5,220,964; U.S. Pat. No. 5,390,750.

The cutting elements of back reamers often experience high wear rates, while other portions of the back reamers are not exposed to equivalent wear conditions. Thus, modular backreamers have been developed to minimize repair costs. Examples of such backreamers are disclosed in US20020108785; US20020088649; U.S. Pat. No. 6,386,298; U.S. Pat. No. 5,979,574; and U.S. Pat. No. 5,979,573.

Although various types of cutting elements are used, many back reamers for boring rock utilize rolling cutters mounted on bearings. Several designs have been developed to minimize the costs of maintaining these rolling cutters, examples are disclosed in U.S. Pat. No. 4,509,607; and U.S. Pat. No. 6,708,786.

In order to be able to adapt in a timely manner, the operator of the drill machine needs a variety of backreamers on-hand. The cost of each individual backreamer is significant, thus the inventory costs of backreamers is potentially substantial. There is a need for a backreaming system that provides improved flexibility with a reduced investment.

SUMMARY

One aspect of the present disclosure relates to reamer constructions adapted to facilitate removal of reamer components for repair, replacement or other reasons.

BRIEF DESCRIPTION OF THE DRAWINGS

FIG. 2 is an exploded, front view of a first embodiment of a reamer having features that are examples of inventive aspects in accordance with the principles of the present disclosure;

FIG. 5 is a cross-sectional view depicting a drill stem interface for the reamer of FIG. 2;

DETAILED DESCRIPTION

Reference will be made in detail to example embodiments that are illustrated in the accompanying drawings. Wherever possible, the same reference numbers will be used throughout the drawings to refer to the same or alike parts.

Figure 1:
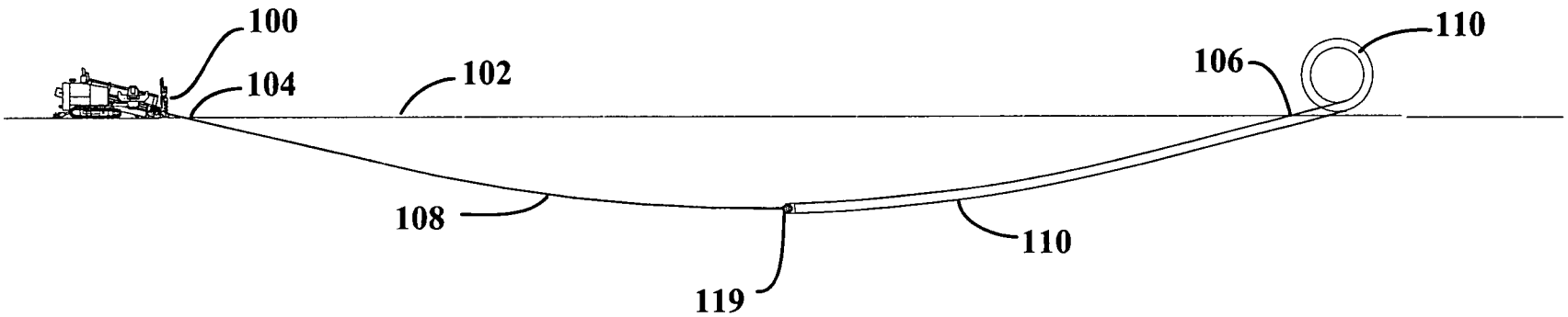
FIG. 1 is a schematic representation of an example horizontal directional drilling system in which backreamers in accordance with the principles of the present disclosure may be used.

FIG. 1 illustrates an example horizontal drilling system in which reamers in accordance with the principles of the present disclosure may be used. The horizontal drilling system includes a drilling machine 100 depicted as a track-type vehicle. The drilling machine 100 includes anchors (e.g., augers) for securing the machine to a ground surface 102. The drilling machine 100 also preferably includes a thrust mechanism for pushing a drill string 108 into the ground to form a pilot bore, and for withdrawing the drill string from the ground. The horizontal drilling machine 100 further preferably includes a rotational drive mechanism for rotating the drill string 108 as the drill string is thrust into the ground or removed from the ground. It will be appreciated that the thrust mechanism of the horizontal drilling machine 100 can be oriented at an angle relative to the ground surface 102 to facilitate driving the drill string into the ground at a desired angle.

In use, the horizontal drilling machine 100 is used to drive the drill string 108 into the ground 102 as shown in FIG. 1. The far end of the drill string 108 is typically equipped with a cutting tool for cutting the pilot bore. To lengthen the pilot bore, pipes are sequentially added to the drill string until the drill string 108 extends from an entry point 104 adjacent to the drilling machine 100 to an exit point 106. Thus, the drill string 108 is formed by a plurality of drill rods connected together. By rotating the drill string 108 while concurrently applying thrust to the drill string, the cutting tool at the end of the drill string cuts the pilot bore.

After the drill string 108 has been pushed from the entry point 104 to the exit point 106, the cutting tool is removed from the far end of the drill string and replaced with a backreamer 119. A utility 110 (i.e., a utility pipe) can be attached to the backreamer 119 with a swivel such that the drill string 108 can rotate independent of the utility. Once the backreamer 119 and the utility 110 have been attached to the drill string 108, the horizontal drilling machine 100 is used to withdraw the drill string 108. As the drill string 108 is withdrawn, the drill string 108 is rotated causing the backreamer 119 to enlarge the pilot bore. As the drill string is withdrawn, the utility 110 is concurrently pulled into the backreamed bore. As shown in FIG. 1, the backreamer 119 has been pulled about halfway back through the pilot bore, and the utility 110 has been installed along about half of the bore path.

Figure 3:
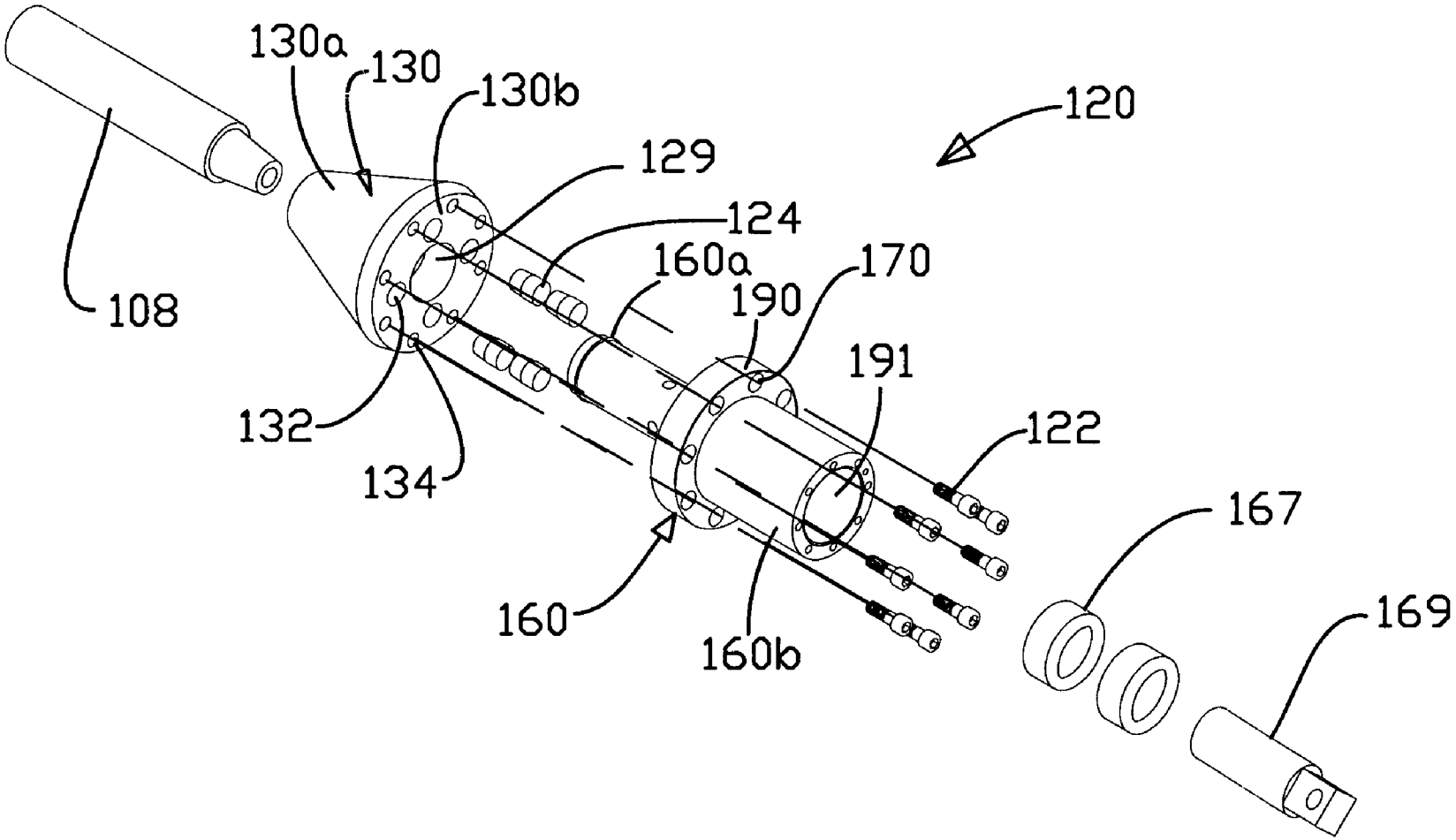
FIG. 3 is a rear, exploded view of the reamer of FIG. 2.
Figure 4:
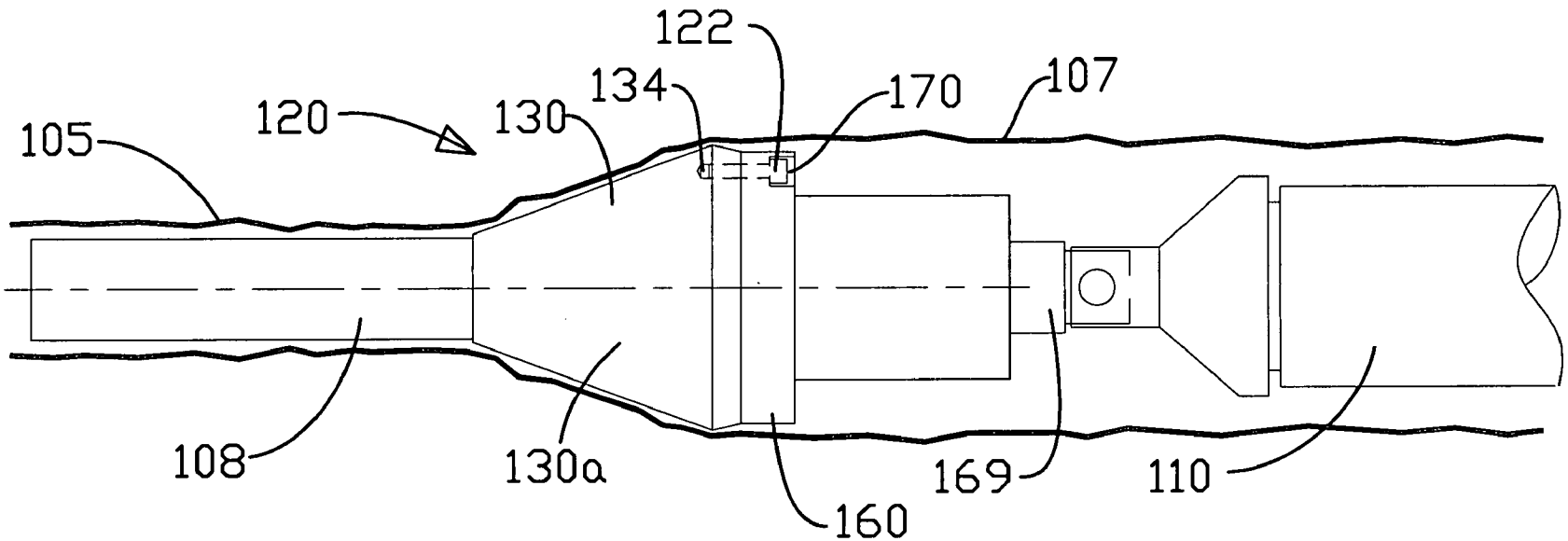
FIG. 4 is a side view of the reamer of FIG. 2 depicted within a pilot bore.

FIGS. 2-6 illustrate a backreamer system 120 having features that are examples of inventive aspects in accordance with the principles of the present disclosure. Referring to FIG. 3, the backreamer system 120 includes a ground engaging body 130, a reamer base 160 and a swivel spud 169. The ground engaging body 130 and the reamer base 160 are secured together by fasteners 122. As shown at FIG. 4, a drill string 108 can be connected to the reamer base 160 to pull the backreamer system 120 through a pilot bore 105. The drill string 108 also applies torque to the reamer base 160 for rotating the backreamer system 120 during the backreaming process. As the backreamer system 120 is pulled through the pilot bore, the ground engaging body 130 functions to enlarge the pilot bore 105 to provide an enlarged bore 107. The swivel spud 169 provides a connection location for connecting a utility 110 (shown at FIG. 4) to the backreamer system 120. In this way, the utility can be simultaneously pulled into the ground along with the backreamer system 120 as the pilot bore 105 is reamed.

Referring again to FIG. 3, the ground engaging body 130 of the backreamer system 120 includes a front face 130*a* and a back face 130*b*. The front face 130*a* is adapted for engaging the ground to enlarge a pilot bore. As shown in FIG. 3, the front face 130*a* has a tapered (e.g., conical) shape. It will be appreciated that cutting elements (e.g., edges, ridges, blades, cutters or other structures) can be provided at the front face 130*a*.

Figure 6:
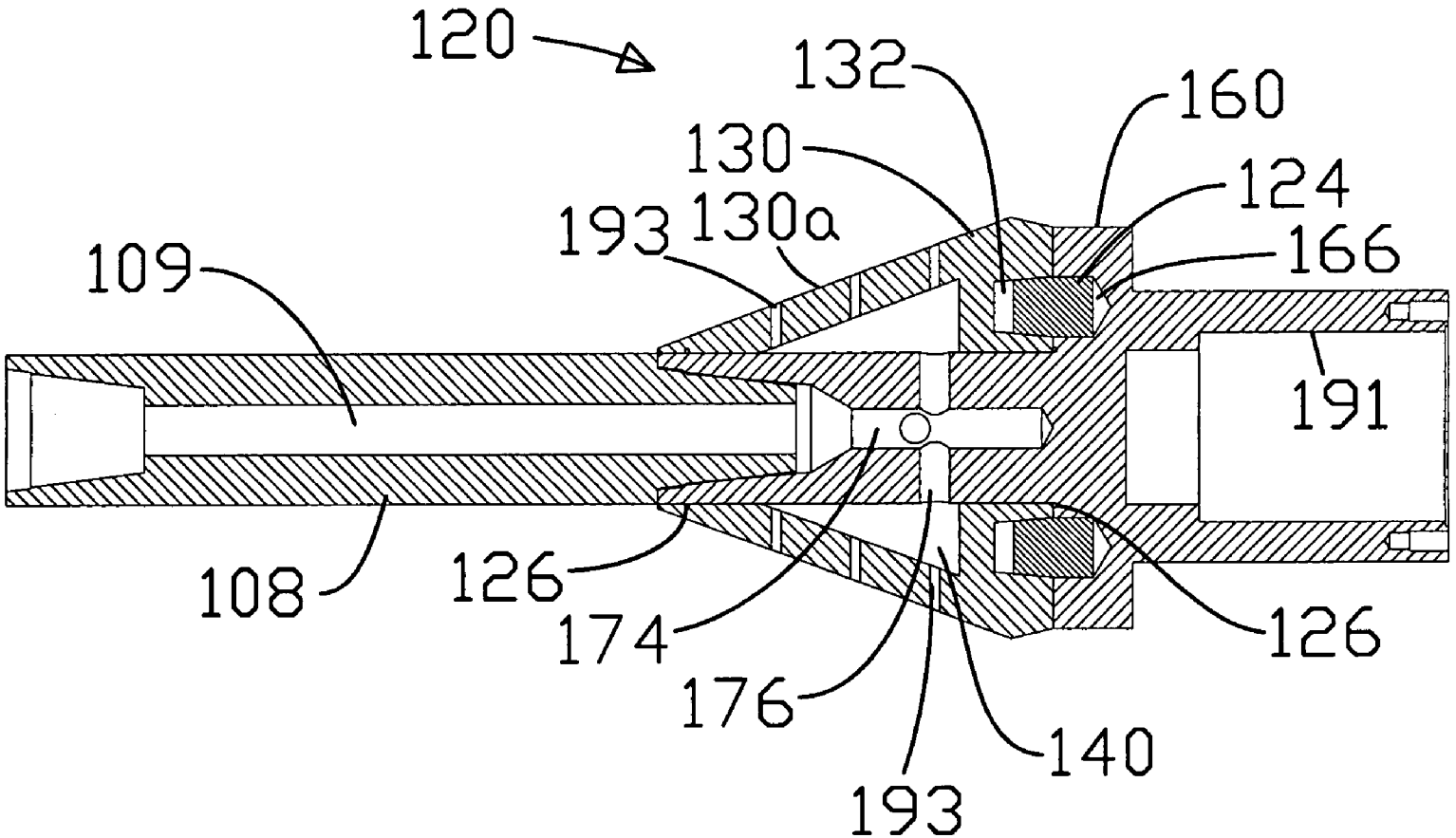
FIG. 6 is a cross-sectional view taken along section line 6-6 of FIG. 4.

The rear face 130*b* of the ground engaging body 130 provides an interface with the reamer base 160. The rear face 130*b* is generally planar and defines a plurality of openings for use in providing a connection between the ground engaging body 130 and the reamer base 160. For example, the rear face 130*b* defines torque drive holes 132 circumferentially spaced about a center axis of the ground engaging body 130. Additionally, the rear face 130*b* defines internally threaded fastener openings 134 that are also circumferentially spaced about the center axis of the ground engaging body 130. As best shown in FIGS. 3 and 6, the ground engaging body 130 further defines a primary center opening 129 that extends through the body 130 along its longitudinal axis from the rear face 130*b* to the front face 130*a*.

Referring to FIGS. 3 and 6, the reamer base 160 of the backreamer system 120 includes a leading end 160*a* and a trailing end 160*b*. The reamer base 160 also includes a mounting flange 190 positioned approximately midway between the leading and trailing ends 160*a*, 160*b*.

The leading end 160*a* of the reamer base 160 is adapted for connection to the drill string 108. For example, as shown at FIGS. 5 and 6, the leading end 160*a* is depicted as including a female threaded end that mate with a corresponding male threaded end provided on the drill string 108. In this manner, torque and thrust can be transferred between the drill string 108 and the reamer base 160. It will be appreciated that other known connection techniques could also be used.

The trailing end 160*b* of the reamer base 160 is depicted as being adapted for mounting the swivel spud 169. For example, as shown at FIG. 6, the trailing end 160*b* defines a cavity 191 in which swivel spud bearings 167 can be mounted. The swivel spud 169 mounts within the bearings 167 such that the bearings 167 allow for free relative rotation between the spud 169 and the reamer base 160. An end cap or other structure can be fastened to the trailing end 160*b* of the reamer base 160 to retain the bearings 167 and the spud 169 within the cavity 191 of the reamer base 160.

The flange 190 facilitates connecting the reamer base 160 to the ground engaging body 130. For example, as shown at FIG. 2, the flange defines countersunk torque drive holes 166 as well as fastener holes 170. The torque drive holes 166 and the fastener holes 170 are spaced circumferentially around a center longitudinal axis of the reamer base 160. The fastener holes 170 are preferably through-holes that extend completely through the flange 190. When the backreamer system 120 is assembled, the fastener holes 170 align with the fastener openings 134 of the ground engaging body 130, and the torque drive holes 166 of the reamer base 160 align with the torque drive holes 132 of the ground engaging body 130. Fasteners 122 (e.g., bolts) are mounted in the fastener openings 134, 170 to affix the reamer base 160 to the ground engaging body 130. Drive pins 124 are mounted within the torque drive holes 166, 132 to provide torque transfer from the reamer base 160 to the ground engaging body 130. In one embodiment, the drive pins 124 are cylindrical in the portion that fits within the holes 166, and are tapered in the portion that fits within drive holes 132. Preferably, the pins 124 are trapped/captured within the openings 166, 132, as long as the reamer base 160 and the ground engaging body are held together by fasteners 122.

During backreaming operations, it is often desirable to pump drilling fluid to the cutting face of the backreamer to facilitate the backreaming process. Typically, drilling fluid is pumped through the drill string, by the drilling machine or a separate pump, from an above ground location. The drilling fluid assists in cooling the cutting components of the backreamer and also assists in the transportation of cuttings. Cuttings include the native soil that is excavated by the backreaming system. Generally, the cuttings mix with the drilling fluid within the bore to form a slurry. The slurry typically flows through the borehole and exits at either or both of the entry and exit holes.

To accommodate drilling fluid, the backreamer system 120 defines interior passageways in fluid communication with the interior lumen of the drill string such that drilling fluid can be pumped from the interior of the drill string, through the interior of the backreamer system, to the exterior of the backreamer system. For example, as shown in FIG. 6, the reamer base defines an internal cavity 174 in fluid communication with a lumen 109 of the drill string 108. The reamer base 160 further includes radial fluid apertures 176 that provide fluid communication between the internal cavity 174 of the reamer base 160 and an internal cavity 140 defined by the ground engaging body 130. The internal cavity 140 is sealed with o-rings 126 positioned at the interface between the ground engaging body 130 and the flange of the reamer base 160. Openings 193 allow fluid to flow from the internal cavity 140 to the external cutting surfaces of the ground engaging body 130.

Figure 7:
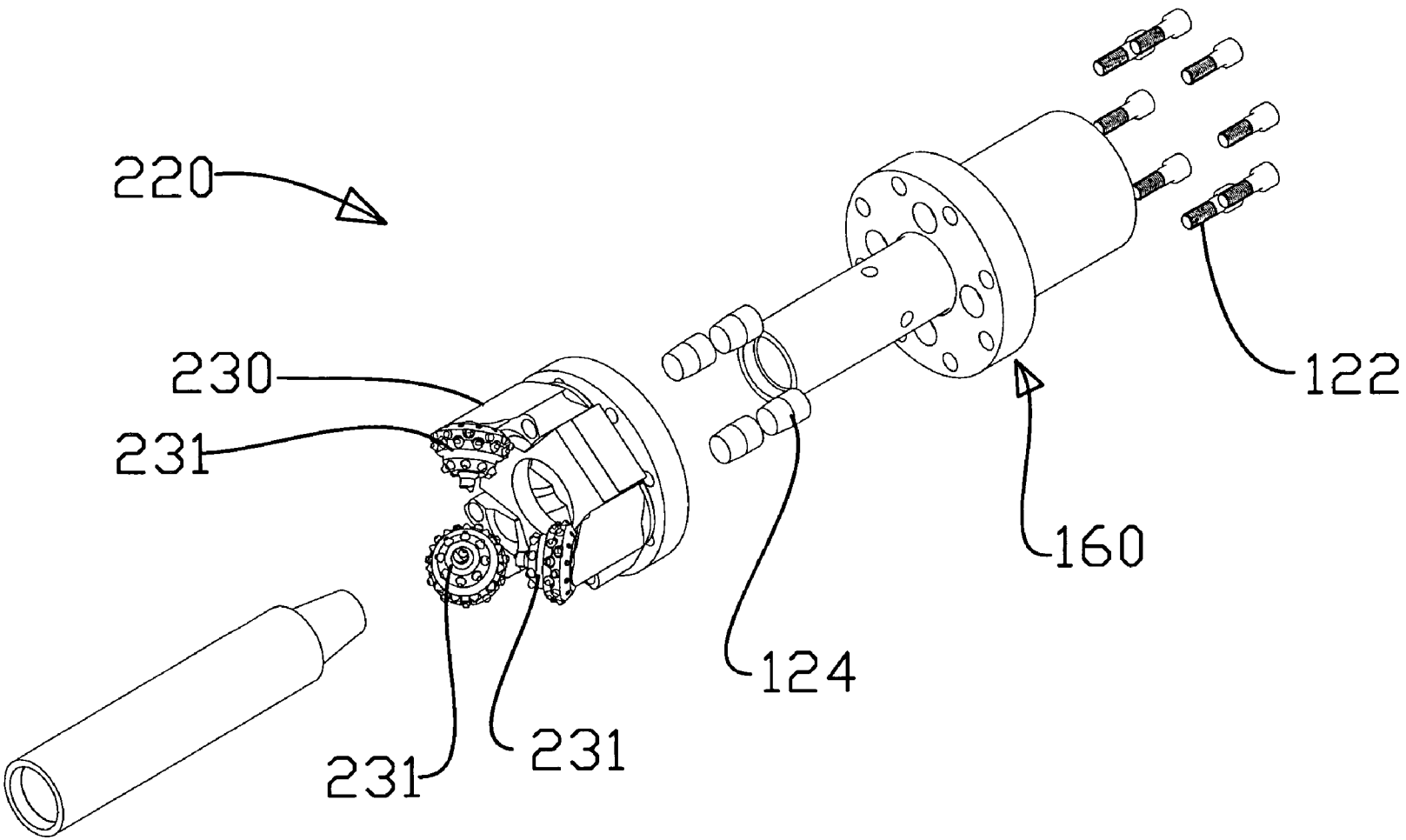
FIG. 7 is a front, exploded view of a second embodiment of a reamer having features that are examples of inventive aspects in accordance with the principles of the present disclosure.
Figure 8:
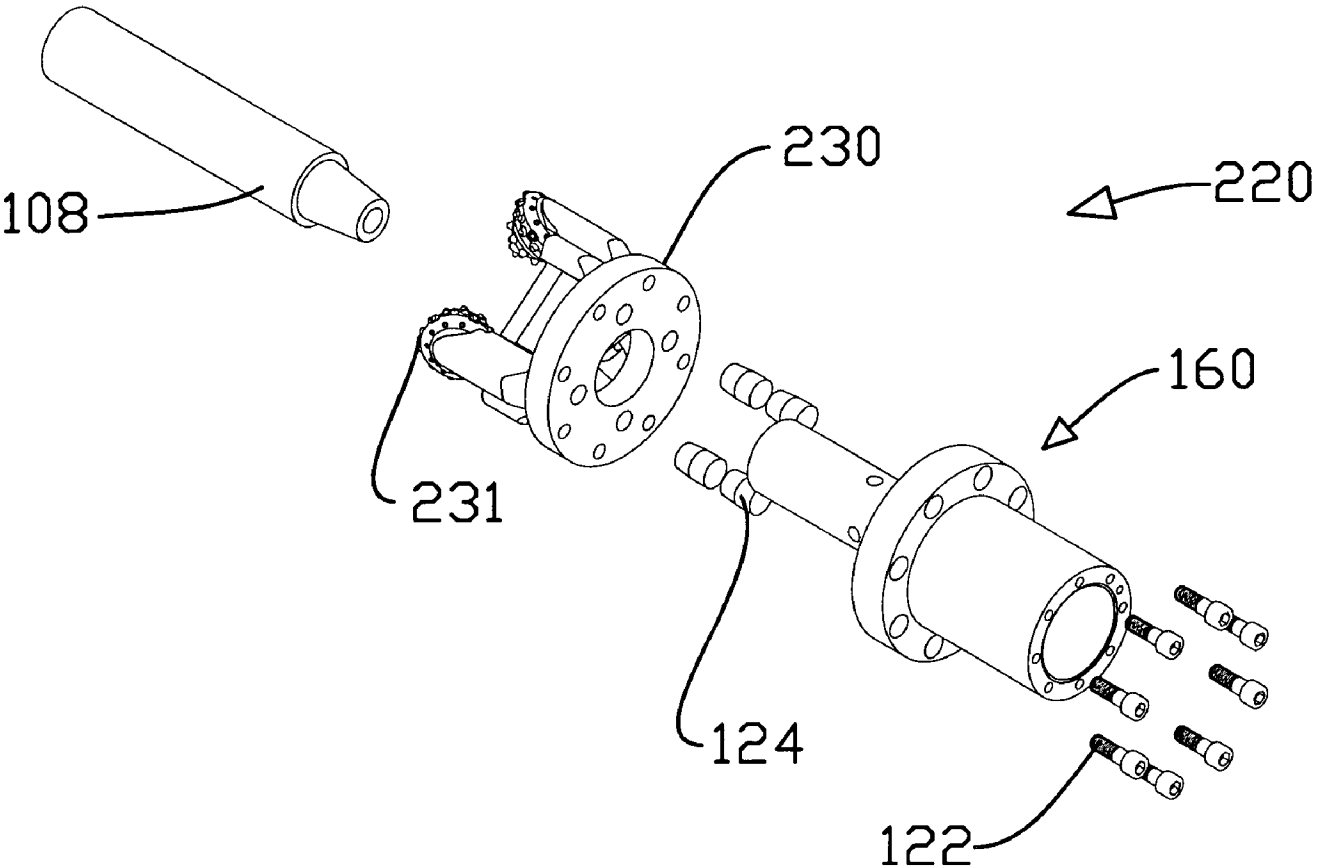
FIG. 8 is a rear, exploded view of the reamer of FIG. 7.
Figure 9:
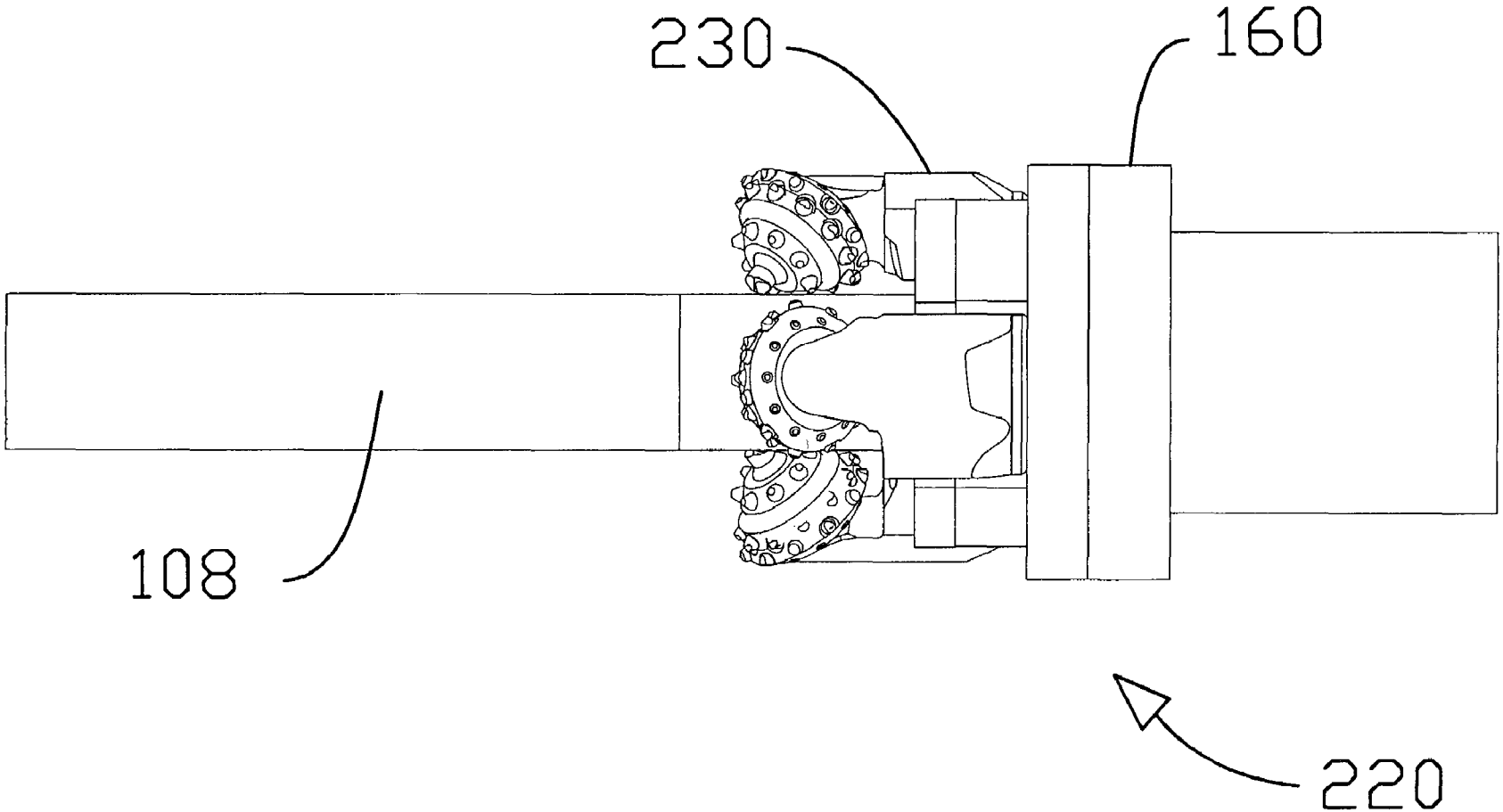
FIG. 9 is an assembled, side view of the reamer of FIG. 7.

FIGS. 7-9 illustrate a second backreamer system 220 having features that are examples of inventive aspects in accordance with the principles of the present disclosure. The system 220 has the same basic configuration as the embodiment of FIGS. 2-6, except the ground engaging body 130 has been replaced with a modified ground engaging body 230 equipped with three cutters 231 (e.g., roller cones) useful for boring in rocky soil conditions. The ground engaging body 230 is secured to the reamer base 160 in the same manner described with respect to the embodiment of FIGS. 2-6. Thus, it will be appreciated that the ground engaging bodies 130, 230 can be readily interchanged with respect to a common base 160 to allow an operator to match the cutting characteristics of the backreamer with the soil conditions of a specific job site.

Figure 10:
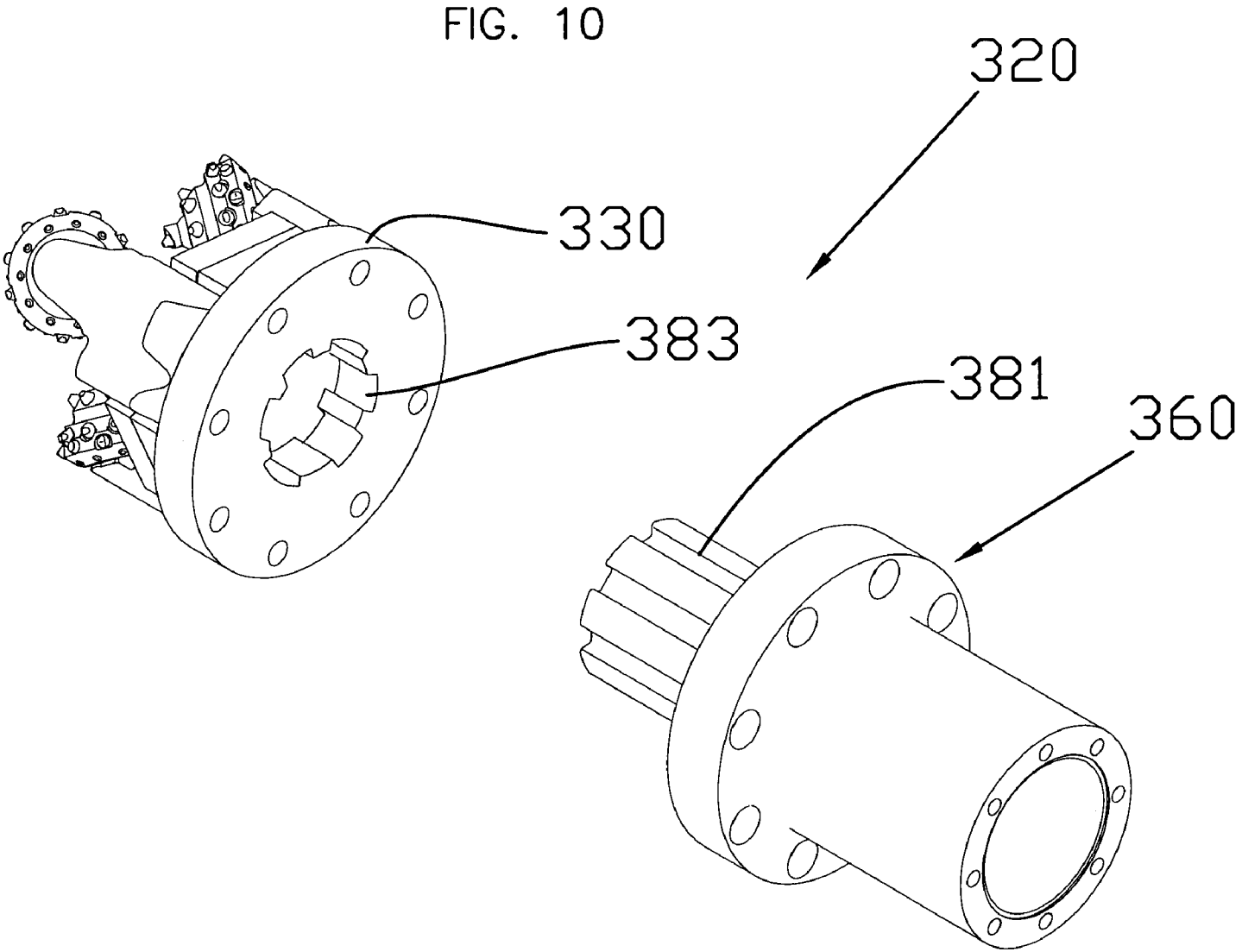
FIG. 10 is a rear, exploded view of a third embodiment of a reamer having features that are examples of inventive aspects in accordance with the principles of the present disclosure.

FIG. 10 illustrates a third backreamer system 320 having features that are examples of inventive aspects in accordance with the principles of the present disclosure. The system 320 includes a ground engaging body 330 that couples to a reamer base 360. The system 320 is similar to the system 220 of FIGS. 7-9, except, rather than using drive pins 124, a splined interface 381, 383 is used to transfer torque between the reamer base 360 and the ground engaging body 330.

Figure 11:
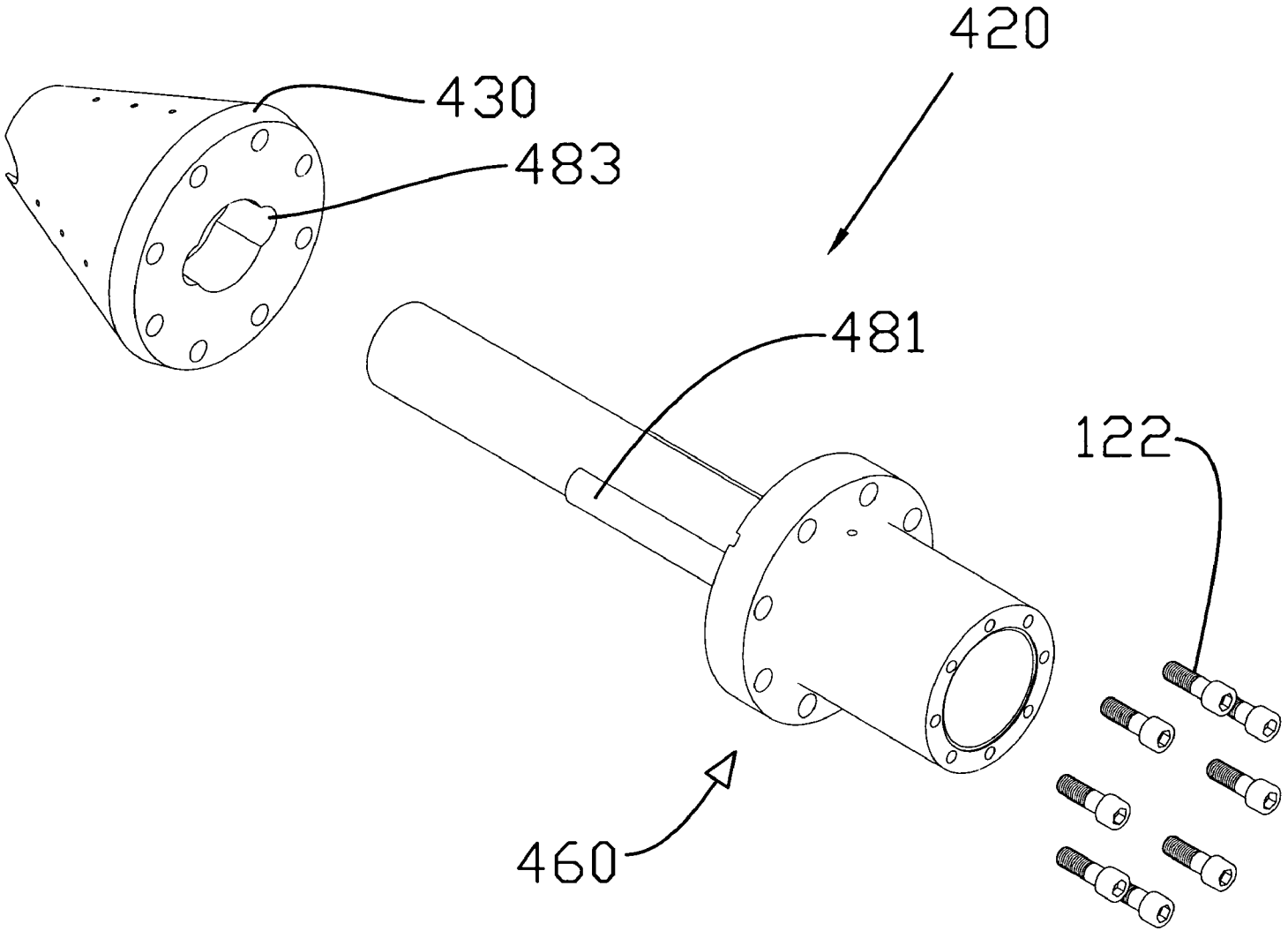
FIG. 11 is a rear, exploded view of a fourth embodiment of a reamer having features that are examples of inventive aspects in accordance with the principles of the present disclosure.

FIG. 11 illustrates a fourth backreamer system 420 having features that are examples of inventive aspects in accordance with the principles of the present disclosure. The system includes a ground engaging body 430 that couples to a reamer base 460. The system 420 has the same configuration as the embodiment of FIGS. 2-6, except, rather than using drive pins 124, torque is transferred between the components 430, 460 by a non-circular cross sectional profile 481 of the reamer base 460 that mates with a corresponding non-circular cross sectional receptacle 483 defined by the ground engaging body 430.

FIGS. 12-15 illustrate a fifth backreamer system 520 having features that are examples of inventive aspects in accordance with the principles of the present disclosure. The backreamer system 520 includes a backreamer base 562 having a first end 562*a* positioned opposite from a second end 562*b*. A roller cone mounting assembly 563 is used to secure a plurality of roller cones 500 to the base 562. The roller cone mounting assembly 563 includes a first mounting structure 560 secured to the base 562, and a second mounting structure 530 secured to the first mounting structure 560. The roller cones 500 are mounted on roller cone shafts 580 which extend between the first mounting structure 560 and the second mounting structure 530.

Figure 12:
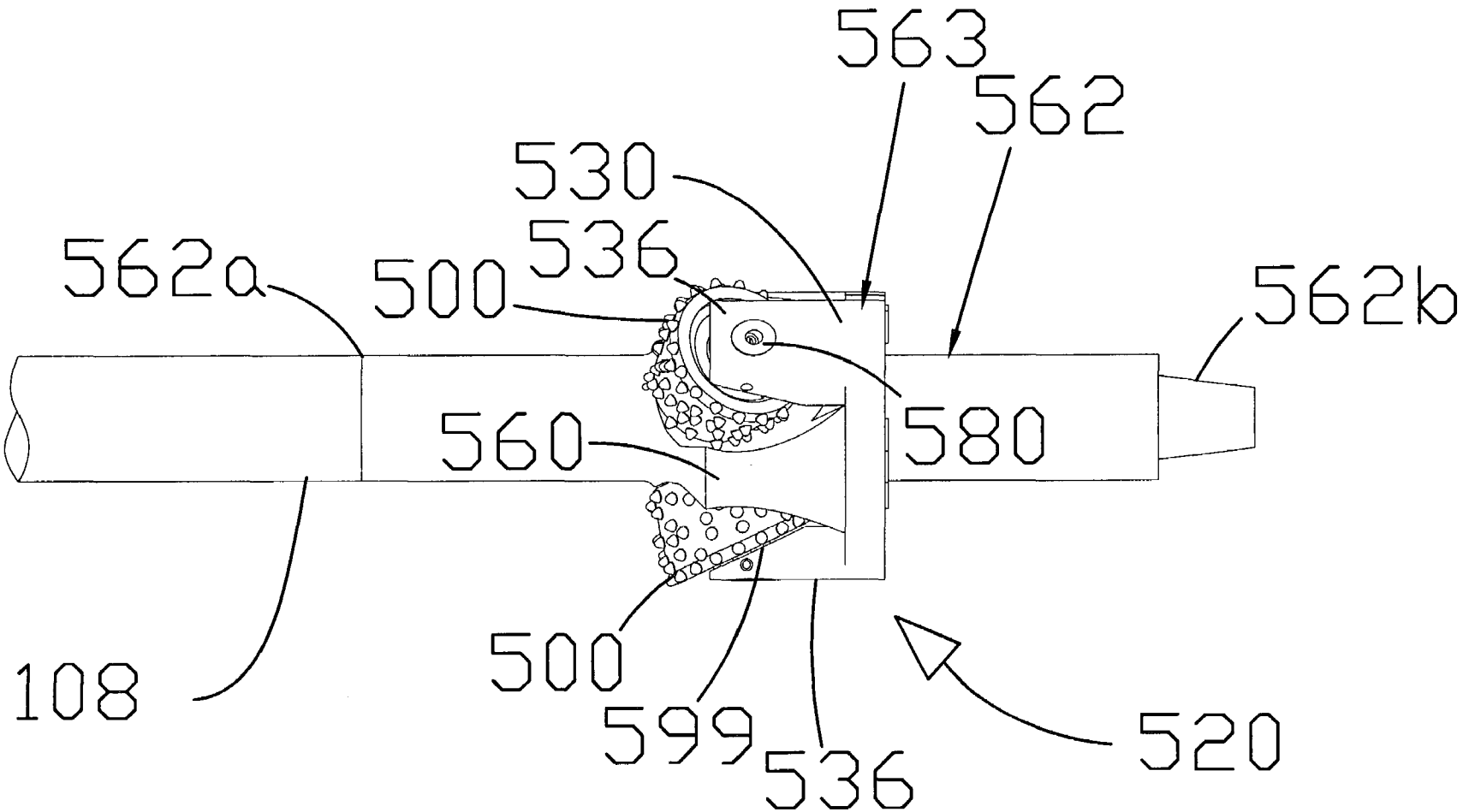
FIG. 12 is an assembled side view of a fifth embodiment of a reamer having features that are examples of inventive aspects in accordance with the principles of the present disclosure.
Figure 13:
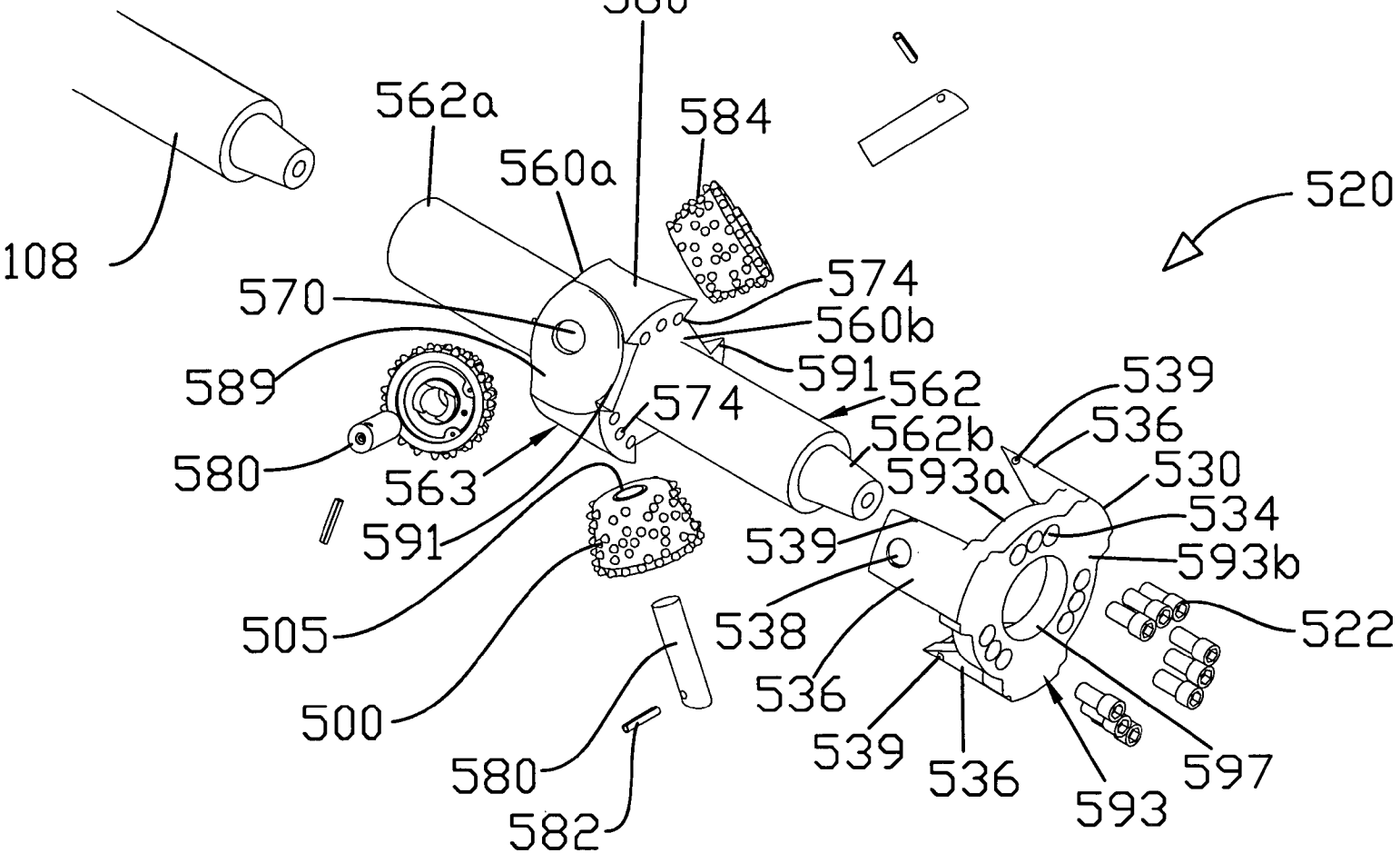
FIG. 13 is a rear, exploded view of the reamer of FIG. 12.

Referring to FIGS. 12 and 13, the first end 562*a* of the base 562 is adapted for connection to the drill string 108. For example, in one embodiment, the end 562*a* can include a female threaded end adapted to engage a corresponding male threaded end defined by the drill string 108. It will be appreciated that other connecting techniques could also be used.

The second end 562*b* of the base 562 is adapted for connection to a swivel structure used to connect the backreamer system to a utility product to be installed in a bore being reamed. As shown in FIGS. 12 and 13, the second end 562*b* is depicted as a female threaded end. In alternative embodiments, a configuration such as a male threaded end, a swivel housing similar to the embodiment of FIGS. 2-6, or other configurations, could also be used.

Referring still to FIGS. 12 and 13, the first mounting structure 560 is shown secured to the base 562 at a location between the first and second ends 562*a*, 562*b*. In one embodiment, the first mounting structure 560 is secured to the base 562 by a permanent connection such as a weldment. The first mounting structure 560 includes a leading face 560*a* and a trailing face 560*b*. A plurality of fastener openings 574 are defined at the trailing face 560*b*. The first mounting structure 560 also includes a plurality of roller cone retention surfaces 589 circumferentially spaced about a longitudinal axis of the base 462. The roller cone retention surfaces 589 are recessed within (e.g., machined into) the body of first mounting structure 560 and face generally radially outwardly from the longitudinal axis of the base 562. In one embodiment, the surfaces 589 are planar and are aligned at an oblique angle relative to a longitudinal axis of the base 580. The first mounting structure 560 also defines angled notches 591 that provide a transition between the roller cone retention surfaces 589 and the trailing face 560*b* of the mounting structure 560. Shaft openings 570 for receiving inner ends of the roller cone shafts 580 are positioned at the roller cone retention surfaces 589.

The second mounting structure 530 includes a main plate 593 and a plurality of roller cone retaining arms 536. The plate 593 includes a leading 593*a* and a trailing face 593*b*. Fastener openings 534 extend through the plate 593 between the faces 593*a*, 593*b*. A center opening 597 also extends between the faces 593*a*, 593*b*. The roller cone retaining arms 536 project outwardly from the leading 593*a* of the plate 593. The roller cone retaining arms 536 define shaft openings 538 for receiving outer ends of the roller cone shafts 580. The retaining arms 536 define retaining pin openings 539 that are transversely aligned relative to the shaft openings 538. The retaining arms 536 further include roller cone retention surfaces 599 at which the shaft openings 538 are located. The surfaces 599 (shown at FIG. 12) are preferably obliquely aligned relative to a central axis that passes through the center opening 597 of the second mounting structure 530.

Figure 14:
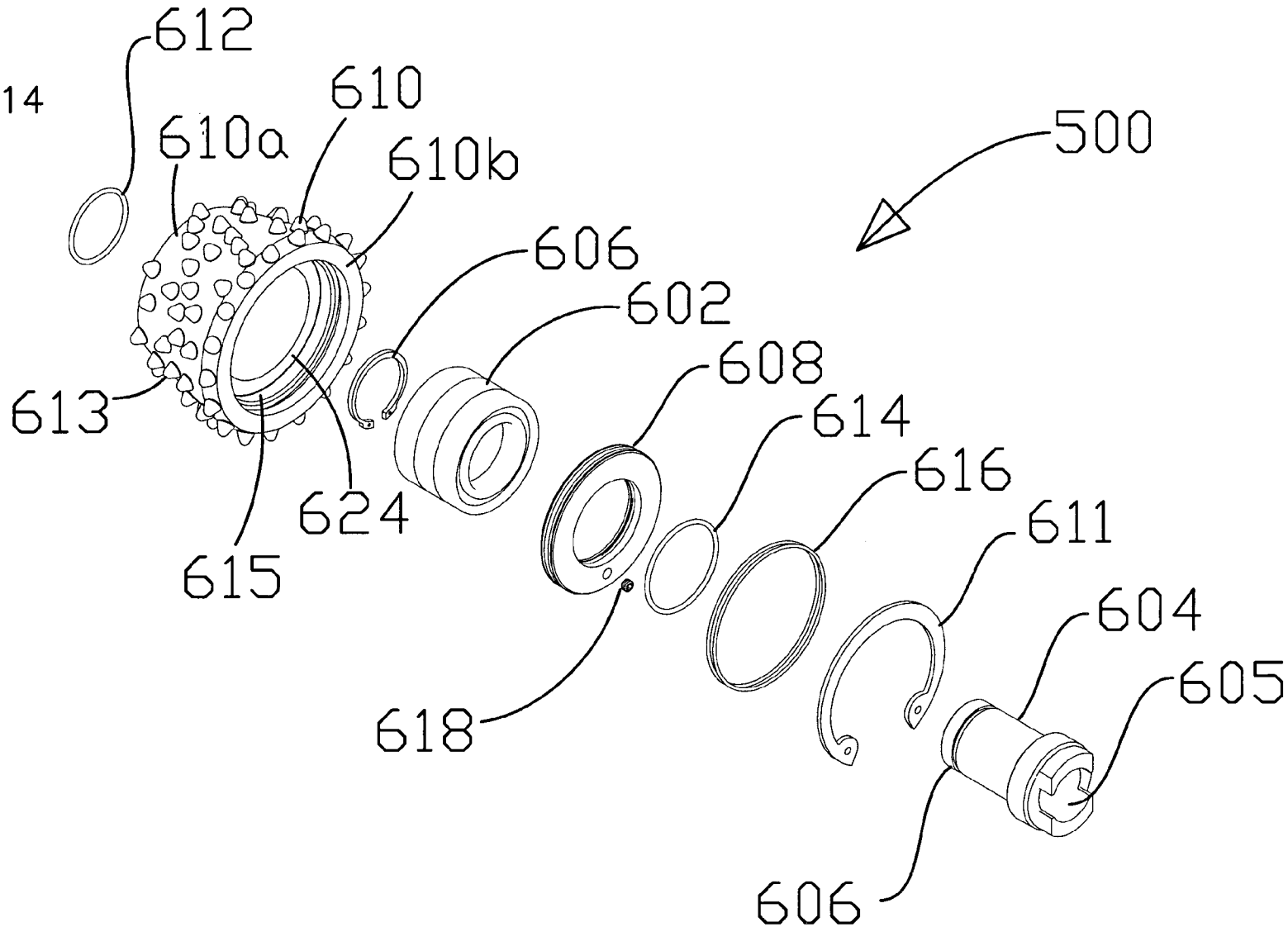
FIG. 14 is an exploded view of a roller cone assembly of the reamer of FIG. 12.

As shown in FIG. 14, each of the roller cones 500 includes a main body 610 having a minor diameter end 610*a* positioned opposite from a major diameter end 610*b*. A plurality of cutting teeth 613 are secured to the exterior of the main body 610. A bearing cavity 615 is defined within the main body 610 of the roller cone 500. Bearings 602 are mounted within the cavity 615. For example, the bearings 602 can include outer races press fit within the cavity 615 and inner races press fit on a bearing pin 604. A snap ring 606 snapped within groove 603 can be used to retain the bearings 602 on the bearing pin 604.

Figure 15:
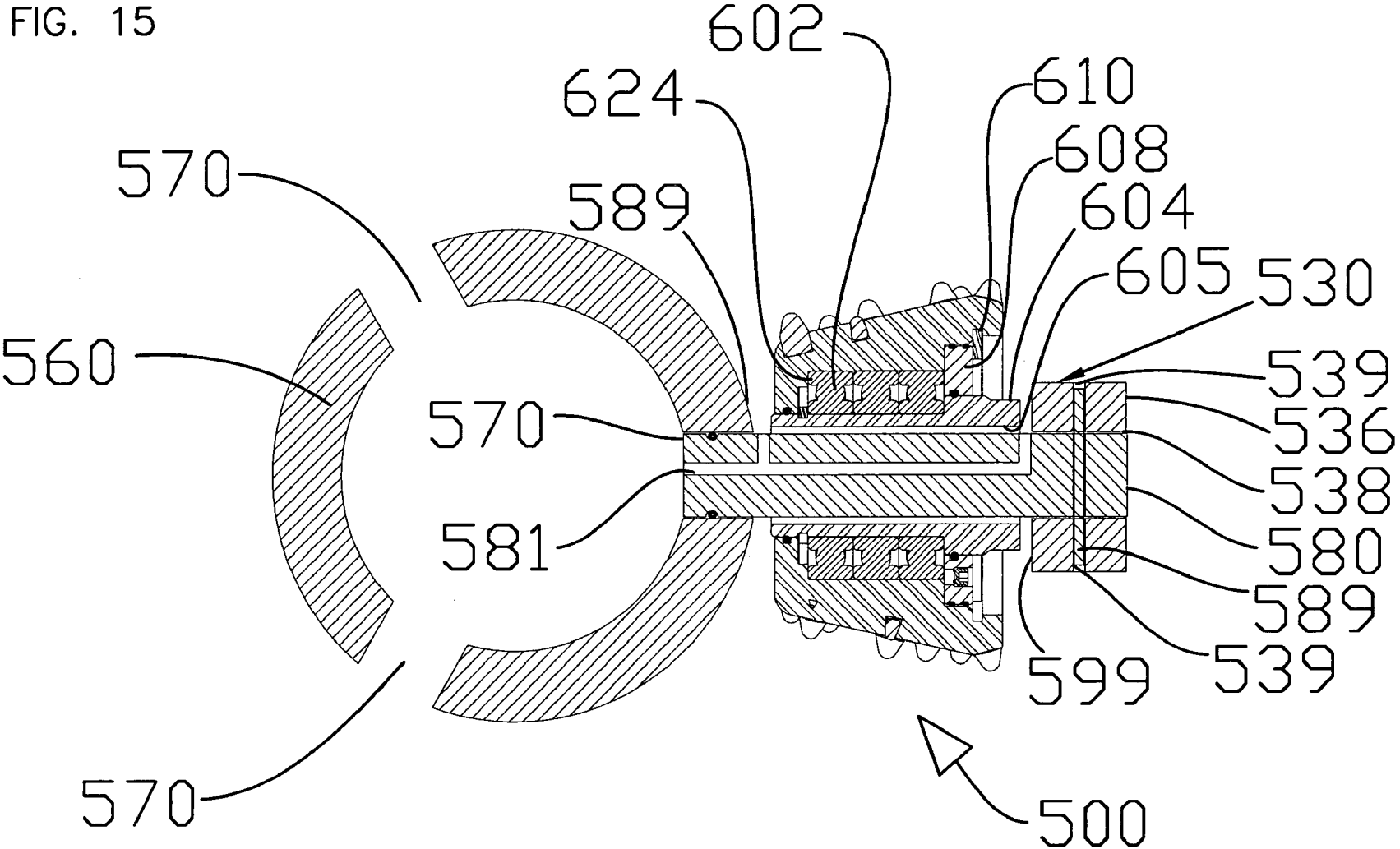
FIG. 15 is a schematic cross-sectional view of the roller cone assembly of FIG. 14.

FIG. 15 shows the bearings 602 mounted within the cavity 615 of the main body 610. The bearings 602 are captured in the cavity 615 between a shoulder 624 and a spacer 608. The spacer 608 is retained within the cavity 614 by a snap ring 611. Grease seals 612, 614 and 616 seal the cavity 615. A removable plug 618 allows grease to be pumped into the bearing cavity 615.

To assemble the reamer, the second end 562*b* of the base 560 is inserted through the central opening 597 of the second mounting structure 530. The second mounting structure 530 is slid along the base 560 until the main plate 593 seats against the trailing face 560*b* of the first mounting structure 560. The second mounting structure 530 is oriented with its fastener openings 534 aligned with the fastener openings 574 of the first mounting structure 560. Fasteners 522 (e.g., bolts) are mounted through the openings 534, 574 to secure the second mounting structure 530 to the first mounting structure 560. The roller cones 500 are mounted between the retention surfaces 589, 599 of the mounting structures 560, 530. In one embodiment, the cones 500 are mounted with the minor diameter ends 610*a* facing inwardly toward the surfaces 589 of the first mounting structure 560, and the outer diameter ends 610*b* facing outwardly toward the surfaces 599 of the second mounting structure 530.

As shown at FIG. 15 (where only one of the three cones is schematically depicted), the cones 500 are mounted on shafts 580. The shafts 580 have inner ends mounted within the openings 570 of the first mounting structure 560 and outer ends mounted within the openings 538 of the second mounting structure 530. The shafts 580 extend through center opening 605 of the bearing pins 604. Retention pins 582 are inserted through the pin openings 539 and the shafts 580 to prevent the shafts 580 from backing out of the openings 570, 538. The outer ends of the shafts 580 are angled to provide a flush match with the outer surfaces of the roller cone retention arms 536.

The shafts define interior passages 581 for allowing drilling fluid to be provided to the cutting surfaces of the roller cones 500. The passages 581 are in fluid communication with an interior lumen of the base 560 so that drilling fluid can be pumped through the drill string 108 to the roller cones 500.

The mounting assembly 563 allows the roller cones 500 to be readily removed by disconnecting the mounting structures 560, 530 from one another and/or removing shafts 580. This allows the cones to be readily removed for repair, or for replacement with cones having different cutting characteristics. Furthermore, mounting structures 530 of different sizes can be fastened to the mounting structure 560 to accommodate roller cones of different lengths/sizes adapted to ream holes of different sizes.

What is claimed is:

1. A backreamer comprising:

a base adapted for connection to a drill string, the base defining a longitudinal axis;

a cutter mounting assembly connected to the base, the cutter mounting assembly including an inner mounting feature radially spaced from an outer mounting feature relative to the longitudinal axis of the base, the cutter mounting assembly also including a shaft that extends between the inner and outer mounting features; and a roller cutter mounted on the shaft.

2. The backreamer of claim 1, wherein the inner and outer mounting features include openings for receiving inner and outer ends of the shaft.

3. The backreamer of claim 1, wherein the roller cutter includes a roller cone.

4. The back reamer of claim 1, wherein the inner mounting feature includes a first surface at which a first shaft opening is defined, wherein the outer mounting feature includes a second surface at which a second shaft opening is defined, wherein the shaft has inner and outer ends respectively mounted in the first and second shaft openings, and wherein the roller cutter is mounted between the first and second surfaces.

5. The backreamer of claim 1, wherein the inner mounting feature is provided at a body connected to the base, wherein the second mounting feature is provided at an arm that is outwardly offset from the body, and wherein the roller cutter is mounted between the body and the arm.

6. The backreamer of claim 5, wherein the arm is part of a component fastened to the body by removable fasteners, and wherein the component can be detached from the body by removing the fasteners.

7. A backreamer comprising:

a base including a forward end and a rearward end, the forward end being adapted for connection to a drill string, the base defining an axis that extends between the forward and rearward ends;

a roller cutter mounting assembly secured to the base, the roller cutter mounting assembly including:

a first mounting structure including a body connected to the base, the base defining a perimeter that extends around the axis of the base, the first mounting structure including first shaft support locations spaced about the perimeter of the body;

a second mounting structure including arms having second shaft support locations spaced outwardly from the first shaft support locations;

shafts having inner ends supported at the first shaft support locations and outer ends supported at the second shaft support locations; and roller cutters mounted on the shafts between the first and second shaft support locations.

8. The backreamer of claim 7, wherein the body of the first mounting structure is permanently connected to the base.

9. The backreamer of claim 8, wherein the second mounting structure is fastened to the base of the first mounting structure by removable fasteners.

10. The backreamer of claim 7, wherein the second mounting structure can be moved relative to the first mounting structure to allow the roller cutters to be removed.

11. The backreamer of claim 7, wherein the roller cutters include roller cones having minor diameter ends positioned adjacent the body of the first mounting structure and major diameter ends positioned adjacent the arms of the second mounting structure.

12. A backreamer comprising:

a base including a forward end and a rearward end, the forward end being adapted for connection to a drill string, the base defining an axis that extends between the forward and rearward ends;

a first mounting structure including a body connected to the base, the body defining a perimeter that extends around the axis of the base, the first mounting structure including a plurality of first roller cone retaining surfaces spaced about the perimeter of the body, the body defining first shaft openings located at the first roller cone retaining surfaces, the body including a forward end and a rearward;

a second mounting structure including a main plate fastened to the rearward end of the body of the first mounting structure, the second mounting structure including roller cone retaining arms that extend forwardly from the main plate, the roller cone retaining arms including second roller cone retaining surfaces that oppose the first roller cone retaining surfaces of the first mounting structure, the roller cone retaining arms defining second shaft openings;

shafts that extend between the first and second roller cone retaining surfaces, the shafts having inner ends mounted within the first shaft openings and outer ends mounted within the second shaft openings; and roller cones mounted on the shafts between the first and second roller cone retaining surfaces.

13. A backreamer comprising:

a base adapted for connection to a drill string;

a cutter mounting assembly connected to the base, the cutter mounting assembly including an inner mounting feature spaced from an outer mounting feature, the cutter mounting assembly also including a shaft that extends between the inner and outer mounting features; and a roller cone mounted on the shaft.

14. A backreamer comprising:

a base adapted for connection to a drill string;

a cutter mounting assembly connected to the base, the cutter mounting assembly including an inner mounting feature spaced from an outer mounting feature, the inner mounting feature being provided at a body connected to the base, the second mounting feature being provided at an arm that is outwardly offset from the body, the cutter mounting assembly also including a shaft that extends between the inner and outer mounting features; and a roller cutter mounted on the shaft between the body of the inner mounting feature and the arm of the outer mounting feature.

15. The backreamer of claim 14, wherein the arm is part of a component fastened to the body by removable fasteners, and wherein the component can be detached from the body by removing the fasteners.

* * * * *